US005649493A

United States Patent [19]

Blume

[11] Patent Number: 5,649,493

[45] Date of Patent: Jul. 22, 1997

[54] DEVICE FOR ADJUSTING THE HEIGHT POSITION OF A TABLE TOP

[75] Inventor: Wolfgang Blume, Nienburg/Weser, Germany

[73] Assignee: Heinrich Oelschläger Metallwarenfabrik GmbH & Co., Hoya, Germany

[21] Appl. No.: 542,349

[22] Filed: Oct. 12, 1995

[30] Foreign Application Priority Data

Oct. 14, 1994 [DE] Germany ..... 44 36 839.9
May 18, 1995 [DE] Germany ..... 195 17 825.4

[51] Int. Cl.[6] ..... A47B 9/00

[52] U.S. Cl. ..... 108/145; 108/136; 108/147; 248/178.1; 248/280.11; 297/344.15

[58] Field of Search ..... 108/145, 146, 108/147, 144, 136; 312/27, 28, 319.3, 325; 248/178.1, 279.1, 162.1, 280.11; 297/338, 344.12, 344.15

[56] References Cited

U.S. PATENT DOCUMENTS

| | | | |
|---|---|---|---|
| 2,124,754 | 7/1938 | Simpson et al. | 108/147 X |
| 2,206,788 | 7/1940 | Meacham | 108/147 X |
| 2,645,538 | 7/1953 | Segal | 108/145 |
| 3,339,906 | 9/1967 | Persson | 297/338 X |
| 4,018,487 | 4/1977 | Orr et al. | 312/27 |
| 4,073,240 | 2/1978 | Fly | 108/147 X |
| 4,266,747 | 5/1981 | Souder, Jr. et al. | 248/280.11 |
| 4,431,153 | 2/1984 | Kritske | 108/6 X |
| 4,838,612 | 6/1989 | Cross | 297/338 |
| 5,005,492 | 4/1991 | Ogino et al. | 108/145 |

FOREIGN PATENT DOCUMENTS

| | | | |
|---|---|---|---|
| 2535042 | 2/1977 | Germany | 108/144 |
| 7640895 | 4/1977 | Germany . | |
| 3132783 | 12/1982 | Germany . | |
| 259392 | 1/1949 | Switzerland | 108/145 |
| 959305 | 5/1964 | United Kingdom | 108/136 |

*Primary Examiner*—Peter M. Cuomo
*Assistant Examiner*—Janet M. Wilkens
*Attorney, Agent, or Firm*—Spencer & Frank

[57] ABSTRACT

A table includes a table support; a slide guide secured to the table top; a sliding member received in the slide guide for displacements relative to the table top and parallel to its main plane; a stationary table support; first and second link bars articulated to the table support and the sliding member. The first and second link bars together form a link bar guide. A coupling bar is articulated to a mid region of one of the first and second link bars and to a component affixed to the table top. This construction provides that a pivotal motion of the parallel linkage guide causes a displacement of the sliding member relative to the table top in its main plane and also causes a height-changing displacement of the table top relative to the table support transversely to its main plane, while the table top remains in an unchanged position relative to the main table top plane. Further, a height-arresting device is provided for immobilizing the table top in any height position thereof.

23 Claims, 7 Drawing Sheets

DEVICE FOR ADJUSTING THE HEIGHT POSITION OF A TABLE TOP

CROSS REFERENCE TO RELATED APPLICATION

This application claims the priority of German Application Nos. P 44 36 839.9 filed Oct. 14, 1994 and 195 17 825.4 filed May 18, 1995, which are incorporated herein by reference.

BACKGROUND OF THE INVENTION

This invention relates to a device for adjusting the height level of a table top or the like relative to a table support and is of the type which has height arresting means and parallel linkage guides each having two, parallel-extending guide bars arranged between the table support and the table top.

Devices of the above-outlined type have been developed in a multitude of configurations and structures which substantially fulfill the expected requirements to adapt the height level (for example, the working height) of the table top or the like to the needs at hand. Thus, adjusting devices are known which are of relatively simple structure but permit only a single adjustment upon setup, since a change of the setting is relatively complicated. Other devices which permit the user to perform fine adjustment at any time are relatively complex and expensive. If a table top is to be adapted for both a sitting and a standing position, a relatively large adjustment range, for example, in excess of 500 mm is required. In the field of drafting tables, there are known adjusting devices which permit an adaptation to both the sitting and the standing position and operate with parallelogram-type linkage guides. In addition, such devices also have arresting mechanisms in order to fix the table top in the set position. It is a disadvantage of such known adjusting devices that the table top "wanders" horizontally relative to the table support during height adjustment, so that adjacent such a drafting table sufficient free space must be made available, as described, for example, in German Gebrauchsmuster (utility model) No. 76 40 895.

SUMMARY OF THE INVENTION

It is an object of the invention to provide an improved device of the above-outlined type for adjusting the height level of a table top in a large adjustment range, wherein the the height adjustment and subsequent arresting may be performed in a simple and rapid manner and in which no wandering of the table top occurs in the table top plane relative to the table support during adjustment.

This object and others to become apparent as the specification progresses, are accomplished by the invention, according to which, briefly stated, the table includes a table top; a slide guide carried by the table top; a sliding member received in the slide guide for displacements relative to the table top and parallel to its main plane; a stationary table support; and first and second link bars articulated to the table support and the sliding member. The first and second link bars together form a parallel linkage guide. A coupling bar is articulated to a mid region of one of the first and second link bars and to a component affixed to the table top. This construction provides that a pivotal motion of the parallel linkage guide causes (or is tied to) a displacement of the sliding member relative to the table top in its main plane and also causes (or is tied to) a height-changing displacement of the table top relative to the table support transversely to its main plane, while the table top remains in an unchanged position relative to such main plane. Further, a height-arresting device is provided for immobilizing the table top in any height position thereof.

It is a significant advantage of the invention that in addition to fulfilling the above-stated objects, the construction is particularly simple and economical and further, the invention provides, in a simple manner, for an equalization of the table top weight, including the objects or devices it supports.

According to an advantageous and stable preferred embodiment of the invention, two parallel linkage guides are provided at a lateral distance from one another between the carrier stand (table support) and the table top. The corresponding, parallel-spaced link bars and guide elements of the two parallel linkage guides are expediently connected with one another by transverse members to ensure stability and to prevent twists.

To ensure weight compensation, an equalizing tension spring is provided for each parallel linkage guide between the points of articulation of the link bars in such a manner that the spring force acts in the lifting direction of the table top. Expediently, the equalizing tension spring is designed solely for a weight compensation of the table top, while for an additional weight compensation of objects supported on the table top, a spiral spring is arranged in the region of the locations of articulation of the link bars at the table support, that is, in the region of the lower articulations of the parallel linkage guide. Both the compensating tension spring as well as the spiral spring are preferably adjustable for setting to an initial base position and to take into account various load conditions of the table top.

The height arresting mechanism preferably comprises a lamina brake which locks the link bars in the region of the upper locations of articulation. This is effected, for example, by providing that the lamina brake is effective between the sliding member and one of the link bars.

The above-outlined weight equalizing device for compensating for the own weight of the table top or for the weight of the objects positioned thereon, permits a weight compensation only between certain limits. Additional unbalanced weights are braked generally only by means of the height arresting device to ensure that the table top does not move upwardly or downwardly in case of weight changes. In a particularly advantageous weight equalizing device according to the invention which permits a fine, substantially complete weight compensation over a wide range, a common compensating spring arrangement is provided in the table support transversely between the two parallel linkage guides spaced from one another. The spring arrangement is, at its two ends, connected to each diagonal point of the parallel linkage guides. Such an arrangement has the significant advantage that in case of a table construction with parallel linkage guides disposed bilaterally of the table support, only a single compensating spring device is required. For such a single device sufficient space is available to achieve large spring forces over a large spring stroke, because the transverse arrangement in the table support admits the use of large-volume compensating springs without any disturbance.

To be able to adapt the adjusting mechanism for the table top to a plurality of different loads, the spring force of the compensating spring mechanism is preferably adjustable. In this manner it is feasible to perform a weight equalization, for example, in case of a table top which carries only a slight load, if any. Conversely, it is feasible to compensate for the weight of very heavy objects positioned on the table top, for example, devices or instruments having a weight of 50–80 kg.

The force transmission between the compensating spring device and the parallel linkage guides is effected according to a preferred embodiment of the invention by pull cables which make it possible to direct the spring forces precisely in the diagonals of the parallel linkage guides. A particularly compact construction for the compensating spring device may be achieved when using a compression spring whose ends engage linearly guided slide elements (spring-supporting elements) and the tension cables are coupled in a crossover manner with the guiding elements. In such a solution, an adjustment of the spring force may be effected in a particularly simple manner by providing a linearly guided adjusting element whose distance from one of the slide elements may be varied by means of a spindle. The adjusting element is connected with one of the two tension cables while the other tension cable is coupled to the other slide element.

While the above-outlined embodiments make possible a rapid adjustment by releasing the height-arresting device and lowering or lifting the table top manually wherein the weight of the table top and any object resting thereon is substantially compensated for by a weight compensating device, according to a further advantageous embodiment of the invention, the adjustment and height immobilization is performed by a spindle drive which is driven either manually by means of a crank or by an electric motor with the intermediary of a step-down gearing. The spindle drive which is arranged between the table top and the sliding member, also functions as the height-immobilizing device. Expediently, the spindle drive includes a threaded spindle and a travelling nut mounted on the spindle to travel therealong when the spindle is rotated. The spindle is rotatably and longitudinally fixedly supported in a guide rail mounted on the table top while the travelling nut is affixed to the sliding member shiftable on the guide rail.

According to a further embodiment of the invention, an electric motor is provided which, by means of a spindle drive, exerts its force on two diagonally disposed articulations of the parallel linkage guide. Since such a spindle drive may be of a self-blocking construction, the spindle drive simultaneously serves as a height-arresting device, so that a weight equalizing arrangement may be dispensed with in most cases.

DESCRIPTION OF THE PREFERRED EMBODIMENTS

Figure 1A:
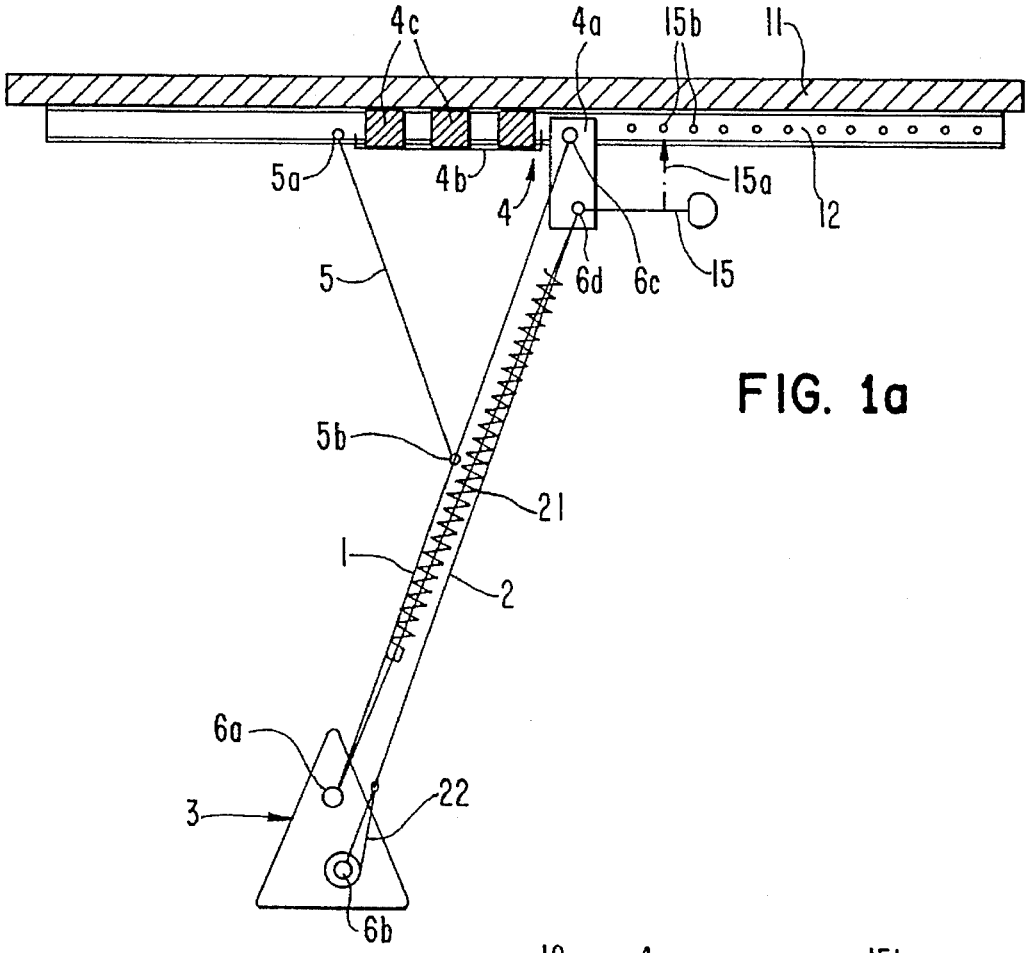
FIGS. 1*a* and 1*b* are schematic side elevational views of a parallel linkage guide forming part of an adjusting device according to the invention, illustrating two different height positions.
Figure 1B:
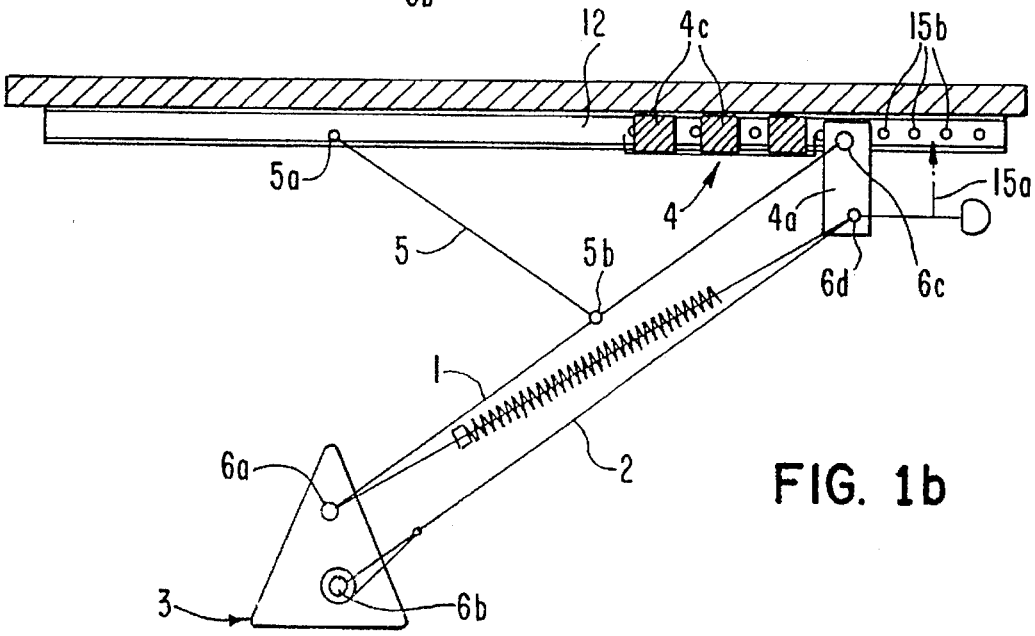
Figure 2A:
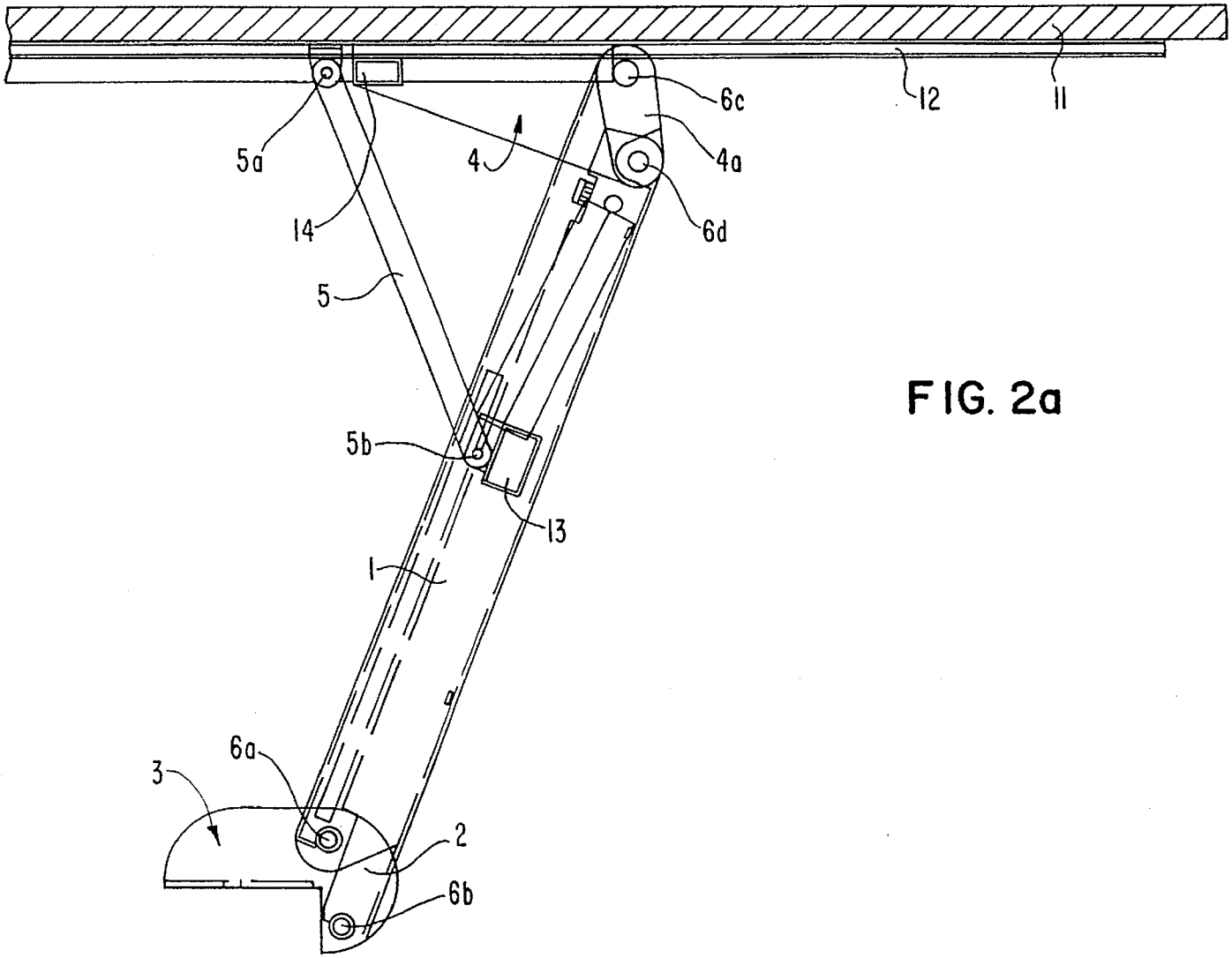
FIGS. 2*a* and 2*b* are side elevational views of a preferred structural embodiment of the invention composed of elements similar to those shown in FIGS. 1*a* and 1*b* and illustrating two different height positions.
Figure 2B:
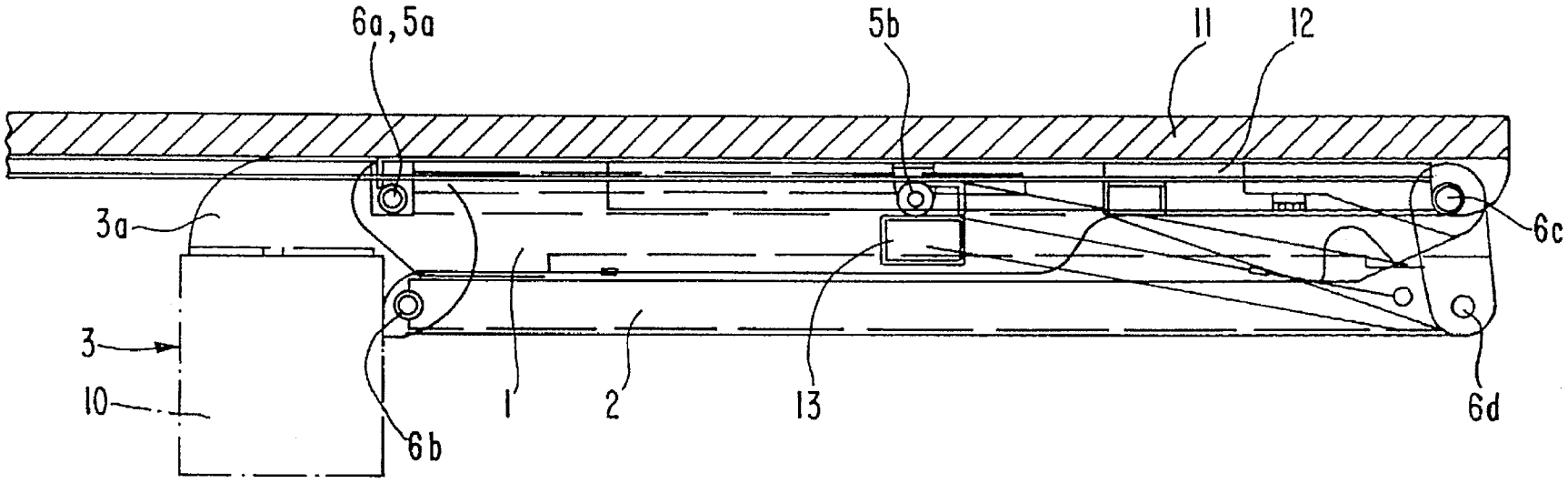

Turning to FIGS. 1*a* and 1*b*, the functional elements of the device according to the invention for the adjustment of the height level (working height) of a table top 11 or similar construction will be set forth. It is noted that FIGS. 1*a* and 1*b* show the functional elements symbolically whereas corresponding FIGS. 2*a* and 2*b* illustrate structural configurations thereof.

The table top 11 is to be steplessly adjusted relative to a table support 3 between a low-level height position shown in FIG. 1*b* and an extended, high-level height position illustrated in FIG. 1*a*. It is noted that FIG. 1*b* shows an intermediate position whereas FIG. 2*b* shows the lower end position (position of lowest level).

On the stand (table support) 3 two stationary articulations such as pivots (pivot shafts) 6*a* and 6*b* are mounted at a distance from one another. The pivots 6*a* and 6*b* are connected with two further pivots 6*c* and 6*d* by means of parallel link bars 1 and 2. The upper pivots 6*c* and 6*d* are arranged in a bracket 4*a* of a sliding member 4 which is slidable relative to the table top 11 parallel to its main plane (which is a plane parallel to or coinciding with the upper surface of the table top). The distance between pivots 6*a* and 6*b* and between pivots 6*c* and 6*d* is less than the length of link bar 1 or 2. The four pivots 6*a*, 6*b*, 6*c* and 6*d*, together with the link bars 1 and 2 form a parallel linkage guide. The parallel linkage guide thus has first, second, third and fourth sides. The first side is formed of the first link bar 1, the second side is formed of the second link bar 2, the third side is formed of the first and third pivots 6*a*, 6*b* at the table support 3 and the fourth side is formed of the second and fourth pivots 6*c*, 6*d* at the sliding member 4. The parallel linkage guide is so oriented that angles formed by the third side with the first and second sides and angles formed by the fourth side with the first and second sides vary upon change of position of the sliding member 4 parallel to the main plane of the table top 11. The parallel guidance is effected by means of glide elements 4*c* which are carried by a holder 4*b* attached to the sliding member 4 and received in a Z-shaped guide rail 12 affixed to the underside of the table top 11. If the sliding member 4 were to be attached fixedly to the table top 11, the latter, upon a change of its height level by virtue of the parallel linkage guides, would be guided in a parallel manner but it would be shifted in the main plane of the table top relative to the table support 3; this would be considered as an undesirable occurrence. To ensure that the table top 11 is maintained relative to the table support 3 at all times in the same position during each height adjustment, a coupling linkage 5 is provided which is articulated with one end to the rail 12 by a pivot 5*a* mounted on the rail 12 provided on the table top 11 and is articulated with its other end to the middle region of the link bar 1 by a pivot 5*b*. The pivots 5*a*, 5*b* and 6*a* define a first isosceles triangle, while the pivots 5*a*, 5*b* and 6*c* define a second isosceles triangle, whereby it is ensured that upon a possibility of a horizontal shifting of the pivot 6*a* relative to the table top 11, the pivot 5*a* and thus the table top 11 always assumes the same position in the table top plane relative to the frame 3.

To provide for a weight compensation for the load on the table top 11, between the pivots 6*a* and 6*d* an equalizing tension spring 21 is provided. The pulling force of the equalizing tension spring 21 is adjustable to set either an equalizing force for an empty (not loaded) table top 11 or to take into account various loads that may be positioned on the table top 11. As shown in FIG. 1*a*, in addition to the equalizing tension spring 21 a spiral spring 22 is provided in the region of the pivot 6*b*, by means of which the load on the table top 11 may be compensated for in an adjustable manner. FIGS. 1*a* and 1*b* further show a tensioning lever 15 with which an arresting device for the adjusting device may be actuated so that for each adjusted height position of the table top 11 the position of the latter may be immobilized. The detailed structural features of the arresting device will be described later as the specification progresses.

FIGS. 2*a*, 2*b*, 3 and 4 illustrate additional details of the actual structure of the device according to the invention. The table support (stand) 3 is formed of an angle member 3*a* with which the entire device, including the parallel linkage guides, the height-arresting device and the superposed table top 11 may be secured to a table undercarriage or the like, such as a transverse carrier 10 of such table stand. FIG. 2*a* shows that the structural height of the adjusting device is very small and that the table top may be extended from such a low position into the uppermost position. The entire parallel linkage guide mechanism forms a substantially closed, compact unit. As shown in particular in the detailed illustration of FIG. 5, the two link bars 1 and 2 are only at a slight distance from one another, they have U-shaped cross sections of different widths and are nested in one another face-to-face. In the upper end position (shown in FIG. 2*a*) the two link bars 1 and 2 are fully nested in one another, while in the lower end position (FIG. 2*b*) there still remains an overlap therebetween.

Figure 3:
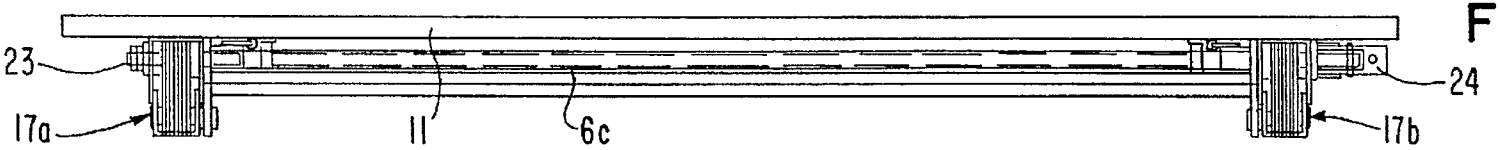
FIG. 3 is a front elevational view of the construction shown in FIGS. 2*a* and 2*b*.
Figure 4:
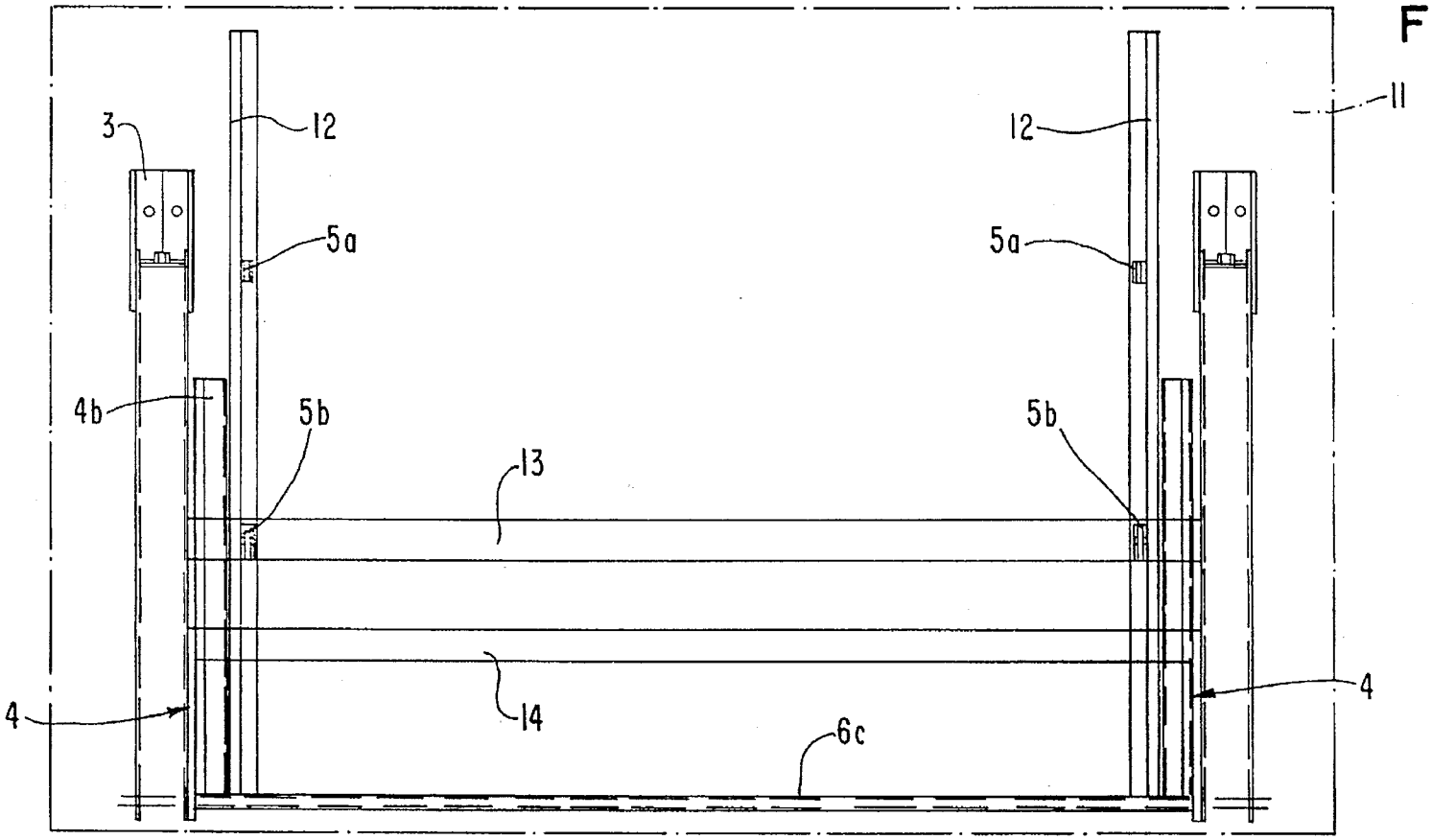
FIG. 4 is a top plan view of the structure shown in FIGS. 2*a*, 2*b* and 3, wherein the table top is shown only in a dash-dotted outline.

The link bars 1 and 2 of the respective side-by-side arranged parallel linkage guides of the entire mechanism are connected with one another by a transverse member 13 to prevent twists during adjustment. Further, the sliding members 4 are connected with one another by transverse members 14. As seen in FIGS. 3 and 4 and particularly in the detailed FIG. 5, the sliding members 4 have on each side a U-shaped profile to ensure a stable positioning of the pivots 6*c* and 6*d*. For effecting a parallel guidance, each sliding member 4 has a holder 4*b* carrying at its end a glide element 4*c* which slides or rolls on the respective Z-shaped guide rail 12, as also shown in FIGS. 1*a* and 1*b*. The glide elements 4*c* extend into the open region of the Z-shaped guide rails 12 which, in turn, are secured to a corresponding carrier on which the table top 11 is supported.

Figure 5:
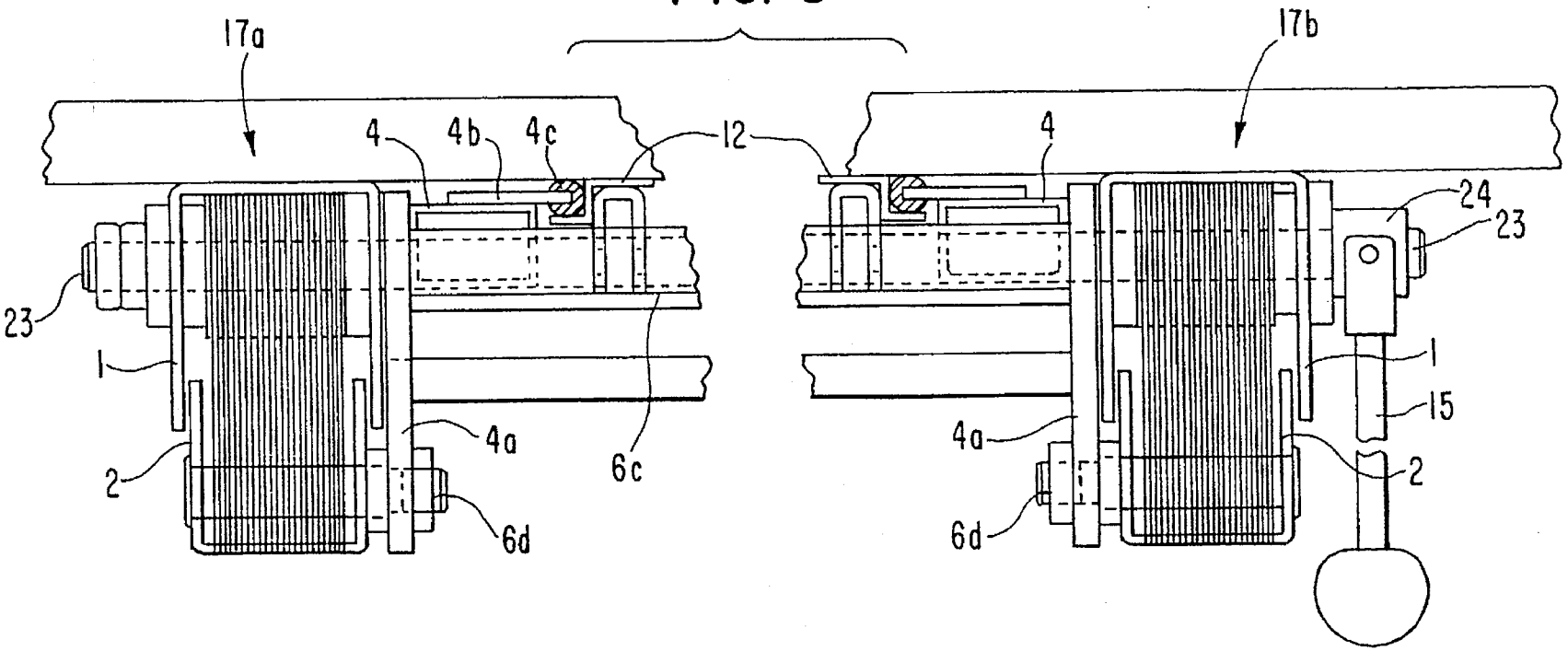
FIG. 5 is an enlarged partial front elevational view similar to FIG. 3, showing further details.

FIG. 5 illustrates the structure of the height immobilizing device. The device includes lamina brakes 17*a* and 17*b* which are arranged in the zone of the upper articulations (pivots) 6*c* and 6*d*, respectively. The lamina stacks are arranged in such a manner that they immobilize the link bar 1 relative to the bracket 4*a* of the sliding member 4 in the braked position so that the parallelogram of the parallel linkage guides cannot undergo deformation. Structurally, the articulation or pivot 6*c* is a tube through which a threaded bar 23 extends. The threaded bar 23 is, as viewed in FIG. 5, at its left end fixed by two nuts whereas at its right end a tensioning nut 24 is arranged. The tensioning lever 15 is coupled to the tensioning nut 24 and by pivoting the tensioning lever 15 about the axis of the threaded bar 23, the tensioning nut 24 may be screwed into the threaded bar 23 and thus the distance between the ends may be varied. In this manner the sheet metal stacks of the lamina brakes 17*a* and 17*b* are jointly compressed in the braking state. Since the tensioning lever 15 is situated close underneath the table top 11, the tensioning nut 24 can normally be turned only about 180°. In the end position, however, the tensioning lever 15 may be turned about the axis of its pivot pin in the opposite direction whereby tensioning steps of 180° are possible. This ensures that a desired frictional braking force for the lamina brakes 17*a* and 17*b* may be obtained.

Many modifications to the above-described particular embodiments are feasible. Thus, the carrier stand (table support) 3 need not be a foot construction but it is possible, by correspondingly shortening the table top 11, to affix the table support 3 against a vertical wall. Also, the sliding guidance between the guide elements 4*c* and the guide rail 12 may be configured differently and it is also feasible to provide other height-arresting devices instead of the above-described lamina brakes 17*a*, 17*b*.

In the embodiments described heretofore, the weight equalization was performed by a tension spring 21. In the description which follows, a specific, additional embodiment will be described.

Figure 6:
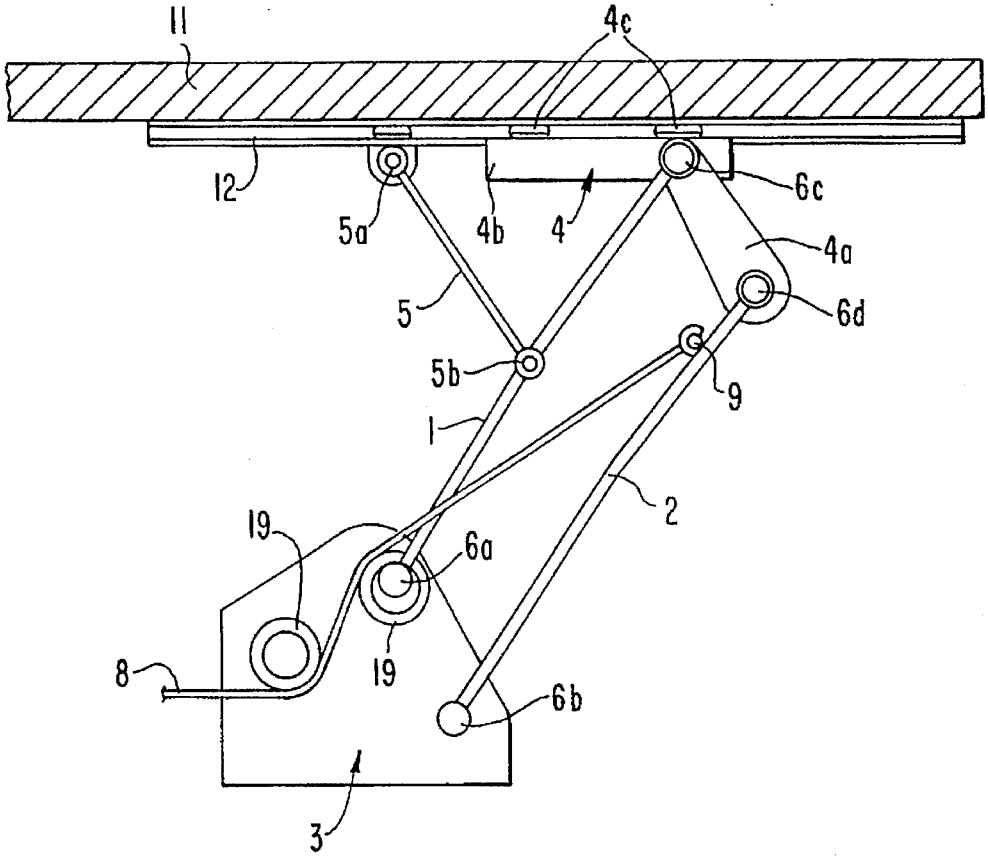
FIG. 6 is a schematic side elevational view of an adjusting device according to the invention, showing parts of a weight compensating arrangement.
Figure 7:
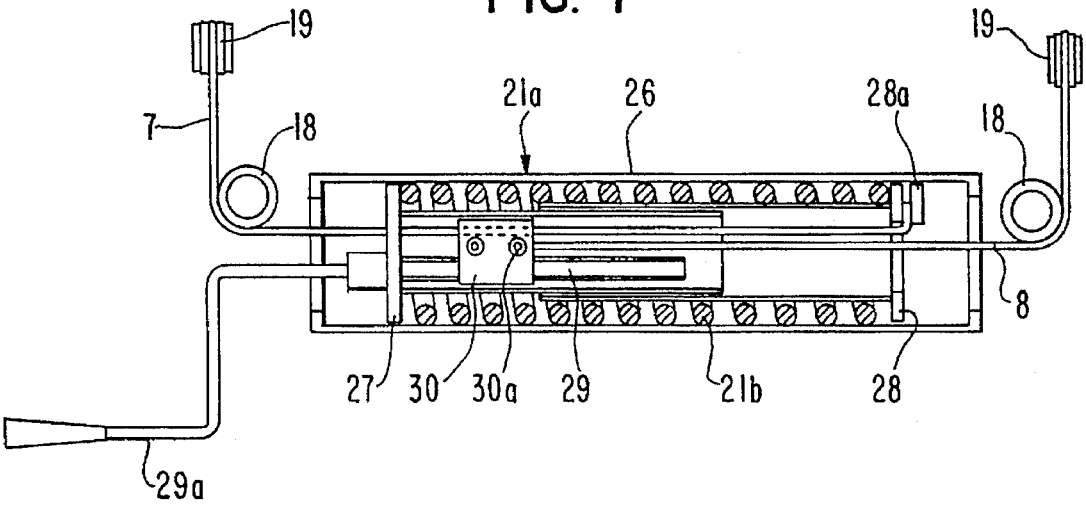
FIG. 7 is a schematic side elevational view of a single compensating spring arrangement serving two parallel linkage guides of the adjusting device according to the invention.

Turning to FIG. 6, only the right-hand side of the device according to the invention is shown. There is illustrated but a single parallel linkage guide, while in reality, there are provided two such guides spaced from one another in a direction parallel to the plane of the drawing, in order to laterally support and adjust the table top 11. Between the two parallel linkage guides of the FIG. 6 construction an equalizing spring arrangement 21*a* according to FIG. 7 is provided and shown at a 90° offset relative to the illustration in FIG. 6. The various elements of the device according to FIG. 6 which correspond to those described in connection with FIGS. 1*a* and 1*b* are provided with the same reference numerals and are not described in further detail.

The equalizing spring arrangement 21*a* shown in FIG. 7 includes a sleeve 26 which is arranged transversely to the table support 3 between the two parallel linkage guides, on a transverse member, such as a cable guide channel. In the sleeve 26 a compression spring 21*b* is disposed between two longitudinally displaceable spring-supporting elements 27 and 28 engaging opposite ends of the spring 21*b*. A tension cable 7 is secured to the spring-supporting element 28 by means of a clip 28*a*. The cable 7, as viewed in FIG. 7, exits from the left side of the sleeve 26. A second tension cable 8 is attached to an adjusting element 30 by means of tightening screws 30*a* and exits from the right-hand side of the sleeve 26 and is trained about the pulleys 18 and 19 as also shown in FIG. 6. The adjusting element 30 may be shifted relative to the spring-supporting element element 27 by means of a spindle 29 that can be turned by a manually engageable crank 29*a*.

The two cables 7 and 8 exert their pulling force—as shown only for the cable 8 in FIG. 6—in the vicinity of the pivot 6*d* of the parallel linkage guide, so that upon relaxing the pressure spring 21*b*, the pivot 6*d* is pulled diagonally to the pivot 6*a* so that a force for lifting the table top 11 is generated. By adjusting the distance between the spring-supporting element 27 and the adjusting element 30 by means of the threaded spindle 29, the force of the compression spring 21*b* may be adjusted, thus changing the spring force affecting the table top 11.

It is noted that the direction of the tension cables 7 and 8 is changed from the transverse direction of the compensating spring device 21*a* into the longitudinal direction (that is, the direction of the link bars 1, 2) by means of first deflecting pulleys 18, while second deflecting pulleys provide that the cables 7 and 8 exert their forces from the direction of the pivot 6*a*, that is, in the diagonal direction. The end of the tension cables 7 and 8 is, for structural reasons, not connected to the pivot 6*d* but to the end of the link bar 2 in the region of the articulation.

It is to be understood that instead of a compression spring as described in conjunction with the compensating spring device 21*a*, it is feasible to provide a common tension spring in the transverse direction of the table support 3 and to cause the ends of the tension spring to directly exert their forces on the respective cables 7, 8. Such a compensating spring arrangement, however, requires a greater structural length and setting the spring force is more complex.

Since the device according to the invention is, for weight compensation, capable of equalizing large table weights (for example, up to 50–80 kg), there are risks that upon removing such a load the table top 11 moves upwardly with great force when the arresting mechanism is released. To prevent such an occurrence, the arresting mechanism includes, in addition to a steplessly engageable, spring-loaded immobilizing brake, a spring-loaded ratchet (detent) mechanism which has a spring-loaded pin 15*a* and a plurality of detent bores 15*b* provided in the guide rail 12 (shown only symbolically in FIGS. 1*a* and 1*b*). Upon releasing the immobilizing brake by the operating lever 15, the detent mechanism 15*a*, 15*b* first remains in engagement and only when a greater stroke is performed by the operating lever 15 will the detent mechanism be released, and then the table top may be height-adjusted.

Figure 8:
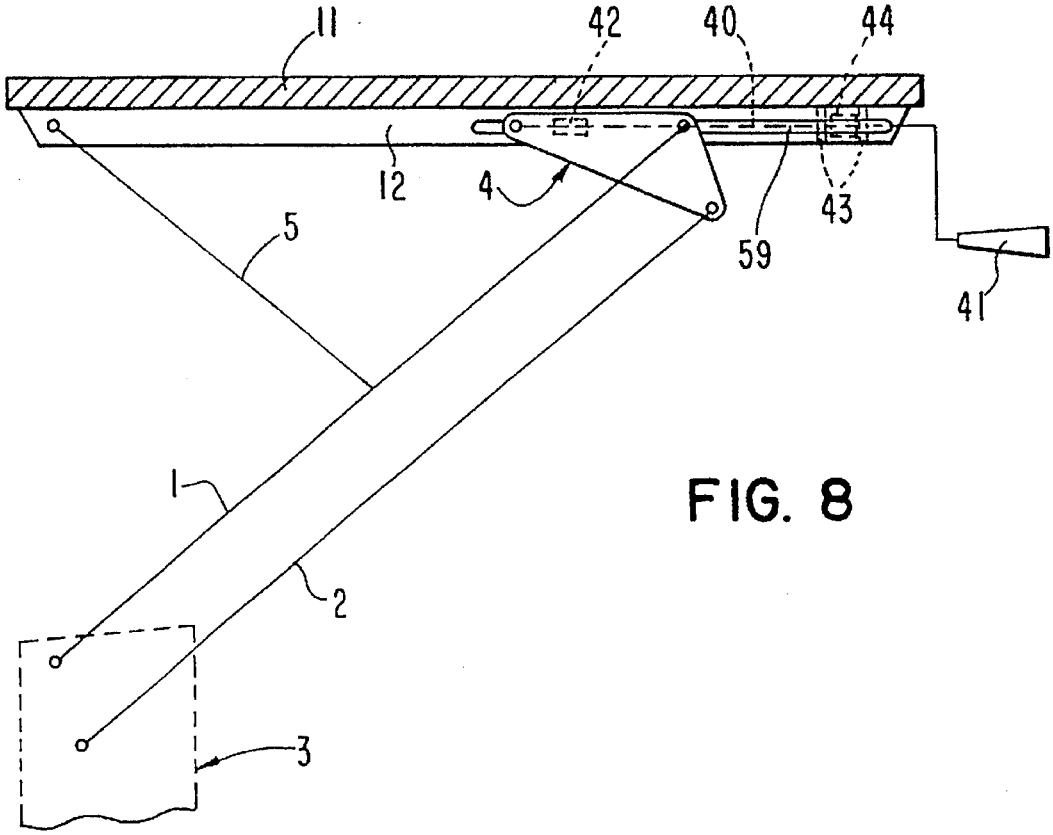
FIGS. 8 and 9 are schematic side elevational views of two additional preferred embodiments of the invention, each including a spindle drive functioning as a height adjusting and height-arresting arrangement.

FIG. 8 illustrates a further preferred embodiment of the invention in which the support of the table top 11 with respect to the table support 3 is structured similarly to the earlier-described embodiments. The device according to FIG. 8, however, has no height-arresting device in the form of a lamina brake as it was described, for example, in connection with FIGS. 3, 4 and 5. Rather, between the table top 11 and the sliding member 4 a spindle drive including a threaded spindle 40 and a travelling nut 42 are provided. The threaded spindle 40 is held axially non-displaceably in the guide rail 12 by means of abutments 43 on the guide rail 12 and an abutment bushing 44 situated therebetween. The abutment bushing 44 is affixed to the threaded spindle. The travelling nut 42 which threadedly engages the threaded spindle 40, is affixed to the sliding member 4 which, as described earlier, is mounted for longitudinal displacement on the guide rail 12 (indicated by a guide slot 59). By rotating the spindle 40, the sliding member 4 is displaced relative to the guide rail 12 and thus relative to the table top 11 whereby the latter is raised or lowered by means of the parallel linkage guide (link bars 1, 2) and by means of the coupling bar 5. The spindle 40 may be rotated either manually by means of a crank 41 or by a non-illustrated electric motor having a step-down gear. Since the spindle drive may be of self-blocking construction, an additional height-immobilizing device is not needed, because the table top 11 is, in each position, securely immobilized by the spindle drive itself, relative to the table support 3. It is to be understood that it is feasible to provide a weight-equalizing device of one of the earlier-described types to remove the load from the spindle drive.

Figure 9:
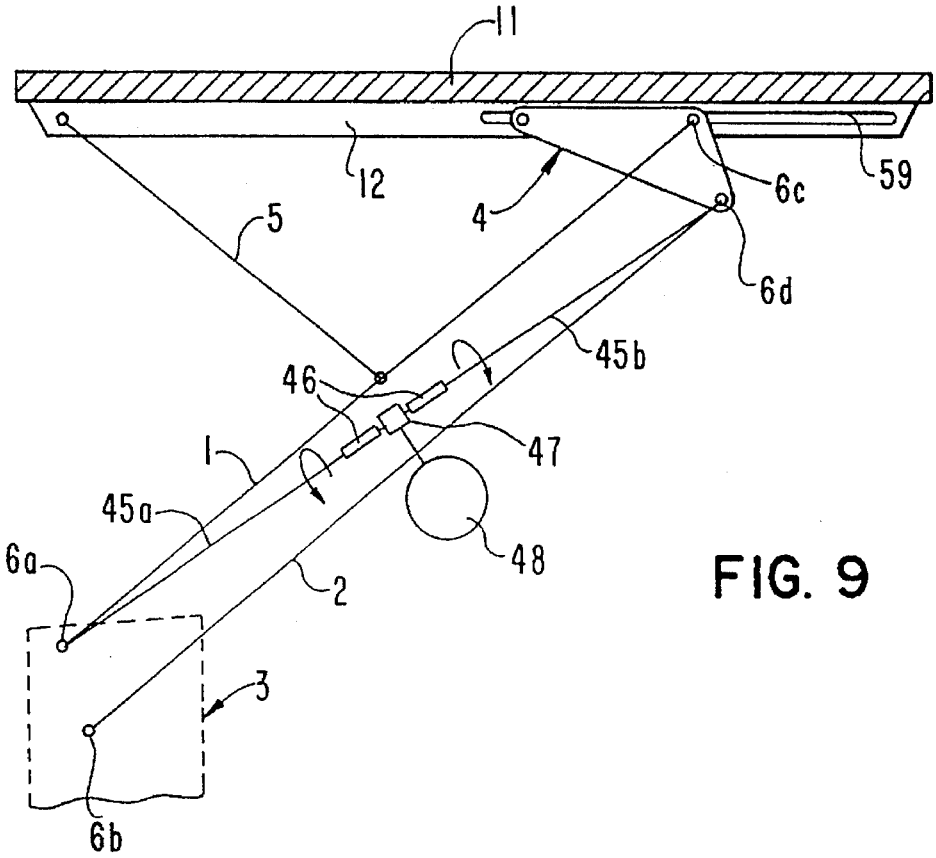

FIG. 9 shows yet another preferred embodiment in which a spindle drive exerts its force to two diagonally oppositely located articulations of the parallel linkage guide, rather than, as in the embodiment according to FIG. 8, between the sliding member 4 and the table top 11 or the guide rail 12. Thus, FIG. 9 shows a spindle drive which exerts its force between the pivots 6*a* and 6*d* of the two link bars 1 and 2, and which is formed of two oppositely threaded spindles 45*a* and 45*b* with oppositely threaded travelling nuts 46 cooperating therewith. The torque to rotate the spindle drive is supplied by an electric motor 48 via a gearing 47. If the two oppositely threaded travelling nuts 46 are rotated in the same direction as shown by the arrows, then by means of the spindles 45*a*, 45*b*, tension or pressure forces are generated between the pivots 6*a*, 6*d* whereby the table top 11 is either raised or lowered. In further respects the parallel linkage guide of the FIG. 9 embodiment, including the link bars 1, 2, operates in the same manner as described in the preceding embodiments. The guidance of the sliding member 4 on the guide rail 12 may be effected either by glide elements or by a guide slot 59 as shown in FIGS. 8 and 9.

It will be understood that the above description of the present invention is susceptible to various modifications, changes and adaptations, and the same are intended to be comprehended within the meaning and range of equivalents of the appended claims.

What is claimed is:

1. A table comprising (a) a table top having a main plane;

(b) a slide guide carried by said table top;

(c) a sliding member received in said slide guide for displacements relative to said table top parallel to said main plane thereof;

(d) a stationary table support;

(e) a first link bar;

(f) a first pivot articulating said first link bar to said table support;

(g) a second pivot articulating said first link bar to said sliding member;

(h) a second link bar extending parallel to said first link bar;

(i) a third pivot articulating said second link bar to said table support;

(j) a fourth pivot articulating said second link bar to said sliding member; said first and second link bars and said first, second, third and fourth pivots together forming a parallel linkage guide having first, second, third and fourth sides; said first side being formed of said first link bar; said second side being formed of said second link bar; said third side being formed of said first and third pivots at said table support; and said fourth side being formed of said second and fourth pivots at said sliding member; said parallel linkage guide being oriented such that angles formed by said third side with said first and second sides and angles formed by said fourth side with said first and second sides vary upon change of position of said sliding member parallel to said table top;

(k) a coupling bar;

(l) a fifth pivot articulating said coupling bar to a mid region of one of said first and second link bars;

(m) a sixth pivot being immovable relative to said table top; said sixth pivot articulating said coupling bar at least indirectly to said table top; whereby a pivotal motion of said parallel linkage guide is tied to a displacement of said sliding member relative to said table top in said main plane and to a height-changing displacement of said table top relative to said table support transversely to said main plane, while said table top remains in an unchanged position relative to said main plane; and (n) height-arresting means for immobilizing said table top in any height position thereof.

2. The table as defined in claim 1, wherein said slide guide comprises a guide rail affixed to said table top.

3. The table as defined in claim 1, wherein said height-arresting means comprises a lamina-stack brake for locking, in an engaged state, said parallel linkage guide in a region of said second and fourth pivots.

4. The table as defined in claim 1, wherein said height-arresting means comprises (a) a spring-loaded, steplessly engageable lamina-stack brake including an actuating lever having an operating stroke for placing the brake into an engaging and a released state when the lever is moved in an engaging and releasing direction, respectively; and (b) detent means cooperating with said actuating lever for maintaining said parallel linkage guide in a locked state after said actuating lever has placed said brake into said released state and for releasing said parallel linkage guide from said locked state upon moving said actuating lever beyond said operating stroke in said releasing direction.

5. The table as defined in claim 1, wherein said first and second link bars each have a U-shaped cross section; said first and second link bars nesting in one another.

6. The table as defined in claim 1, further comprising a spindle drive connected to diagonally located two pivots of said first, second, third and fourth pivots and an electric motor connected to said spindle drive for rotating said spindle drive for causing a pivotal motion of said parallel linkage guide.

7. The table as defined in claim 1, further comprising a spindle drive supported at least indirectly by said table top and being connected to said sliding member, whereby upon actuation of said spindle drive said sliding member is displaced relative to said table top; said spindle drive constituting said height-arresting means.

8. The table as defined in claim 7, wherein said spindle drive comprises (a) a threaded spindle rotatably and longitudinally non-displaceably supported in said slide guide; and (b) a travelling nut threadedly mounted on said spindle for displacement therealong upon rotation of said spindle; said travelling nut being secured to said sliding member.

9. The table as defined in claim 1, further comprising a weight-compensating tension spring connected between said first and fourth pivots for urging said table top away from said table support.

10. The table as defined in claim 9, wherein said tension spring has a spring force for balancing a weight of said table top; further comprising a spiral spring arranged in a region of said first and third pivots; said spiral spring being attached to said parallel linkage guide for urging said table top away from said table support; said spiral spring having a spring force for balancing a weight of an object placed on said table top.

11. The table as defined in claim 10, wherein the spring force of at least one of said springs is adjustable.

12. The table as defined in claim 1, wherein said parallel linkage guide is a first parallel linkage guide; further comprising a second parallel linkage guide structured substantially identically to said first parallel linkage guide and being spaced therefrom.

13. The table as defined in claim 12, further comprising a transverse bar connecting said first and second parallel linkage guides to one another.

14. The table as defined in claim 12, further comprising a weight-compensating device common to said first and second parallel linkage guides for counteracting gravity forces generated by said table top; said weight-compensating device being connected to said first and second parallel linkage guides for exerting a torque thereto, whereby a force is generated urging said table top away from said table support.

15. The table as defined in claim 12, further comprising a weight-compensating device for counteracting gravity forces generated by said table top; said weight-compensating device including (a) a sleeve secured to said table support;

(b) a spring disposed longitudinally in said sleeve and having opposite ends;

(c) first and second spring-supporting elements engaging the opposite ends of said spring; said spring-supporting elements being disposed in said sleeve and being displaceable therein;

(d) an adjusting member longitudinally slidably mounted between said spring-supporting elements;

(e) a first pull cable being attached to said first spring-supporting element and to said first parallel linkage guide;

(f) a second pull cable being attached to said adjusting member and to said second parallel linkage guide; and (g) force-exerting means for displacing said adjusting member relative to said first spring-supporting element.

16. The table as defined in claim 15, wherein said spring is a compression spring.

17. The table as defined in claim 15, further comprising pulleys supported on said table support for guiding said first and second pull cables from said sleeve to said first and second parallel linkage guides, respectively.

18. The table as defined in claim 1, further comprising weight compensating means for exerting a resilient torque on said parallel linkage guide in a direction in which said table top is urged away from said table support to counteract gravity forces acting on said table top.

19. The table as defined in claim 18, wherein said weight compensating means comprises (a) a spring holder secured to said table support;

(b) a spring supported by said spring holder; and (c) a tension cable attached to said spring and to one of said first and second link bars of said parallel linkage guide.

20. The table as defined in claim 19, further comprising spring adjusting means for varying a tension force exerted on said tension cable.

21. The table as defined in claim 20, wherein said spring is a coil spring having opposite ends; further wherein said spring adjusting means comprises (a) two spring-supporting elements engaging said opposite ends of said coil spring; and (b) distance altering means for varying a distance between said two spring-supporting elements for varying the degree of stress on said coil spring.

22. The table as defined in claim 21, wherein said distance altering means comprises (a) a threaded spindle supported by one of said two spring-supporting elements;

(b) a threaded travelling member threadedly mounted on said spindle for displacement relative to said spindle upon rotation of said spindle; said tension cable being attached to said threaded travelling member; and (c) means for rotating said spindle.

23. The table as defined in claim 22, wherein said coil spring is a compression spring.

* * * * *